US007995008B2

(12) United States Patent
Miwa

(10) Patent No.: US 7,995,008 B2
(45) Date of Patent: Aug. 9, 2011

(54) DRIVE CIRCUIT FOR ELECTROLUMINESCENT DEVICE

(75) Inventor: Koichi Miwa, Yokohama (JP)

(73) Assignee: Global OLED Technology LLC, Herndon, VA (US)

( * ) Notice: Subject to any disclaimer, the term of this patent is extended or adjusted under 35 U.S.C. 154(b) by 1004 days.

(21) Appl. No.: 11/385,070

(22) Filed: Mar. 21, 2006

(65) Prior Publication Data

US 2006/0221009 A1 Oct. 5, 2006

(30) Foreign Application Priority Data

Apr. 5, 2005 (JP) ..... 2005-108219

(51) Int. Cl.
*G09G 3/30* (2006.01)

(52) U.S. Cl. ..... 345/76; 345/36; 345/45

(58) Field of Classification Search ..... 345/76–83, 345/90, 204, 36, 45; 327/108
See application file for complete search history.

(56) References Cited

U.S. PATENT DOCUMENTS 6,501,466 B1 * 12/2002 Yamagishi et al. ..... 345/204
2005/0007357 A1 * 1/2005 Yamashita et al. ..... 345/204
2005/0024302 A1 * 2/2005 Akimoto et al. ..... 345/82
2005/0062686 A1 * 3/2005 Iguchi ..... 345/46
2008/0084365 A1 * 4/2008 Takahara et al. ..... 345/76

FOREIGN PATENT DOCUMENTS

JP 2004341444 12/2004
JP 2005141163 6/2005
JP 2005292436 10/2005
JP 2008312215 12/2008

* cited by examiner

*Primary Examiner* — Amare Mengistu
*Assistant Examiner* — Insa Saido
(74) *Attorney, Agent, or Firm* — Morgan, Lewis & Bockius LLP

(57) ABSTRACT

A drive circuit that compensates for the dispersion of the characteristics of drive transistors is disclosed. A switch SW2 is turned off, and switches SW1 and SW3 are turned on. Thereby, a constant current from a constant current source CC1 is flown in a drive transistor T1. Consequently, a gate voltage corresponding to the constant current Is written in the gate of the drive transistor T1. Then, the switches SW1 and SW3 are turned off, and the switch SW2 is turned on. Simultaneously, the voltage of a capacitor C1 on the side of the switch SW4 is varied according to a signal voltage, and thereby the voltage is added to the gate of the drive transistor T1 to flow a current corresponding to the signal voltage in the drive transistor T1.

2 Claims, 9 Drawing Sheets

DRIVE CIRCUIT FOR ELECTROLUMINESCENT DEVICE

FIELD OF THE INVENTION

The present invention relates to a drive circuit of a current drive type light emitting device such as an organic electroluminescence (EL) device.

BACKGROUND OF THE INVENTION

Drive circuits using two thin film transistors (TFTs), such as the circuit shown in FIG. 1 can be used to drive an organic EL device (OLED). The circuit of FIG. 1 is composed of an n-channel writing transistor T2, a holding capacitor C and an n-channel drive transistor T1. The drain of the writing transistor T2 is connected to a signal line DL, through which a signal voltage is supplied; the source thereof is connected to the gate of the drive transistor T1 and one end of the holding capacitor C; and the gate thereof is connected to a control line, through which a selection signal is supplied. Consequently, the signal voltage on the signal line DL is supplied to the one end (the gate of the transistor T1) of the holding capacitor C by raising the control line to an H level. Because the other end of the holding capacitor C is connected to a negative power source (for example, the ground potential), a voltage according to the signal voltage is held in the holding capacitor C.

The drain of the drive transistor T1 is connected to the cathode of an organic EL device OLED, the anode of which is connected to a positive power source (for example, power source potential), and the source of the drive transistor T1 is connected to the negative power source. Consequently, the drain current of the drive transistor T1 is controlled by writing a predetermined signal voltage according to a gradation to the gate node of the drive transistor T1 through the writing transistor T2, and then the drain current flows through the organic EL device OLED to make the organic EL device emit light according to the signal voltage. The transistors employed may be p channel, and circuits using p-channel TFTs are also known.

A drive circuit of the organic EL device that performs threshold value compensation of a drive transistor is shown in US Patent Publication 2004/0174349A1, for example.

For the drive transistor T1, a predetermined signal voltage according to a gradation is written in the gate node of the drive transistor T1, and the drain current thereof according to the gate voltage becomes the drive current of the organic EL device OLED. Consequently, if dispersion of the characteristics of the drive transistors T1 occurs, the display of a uniform gradation cannot be performed, and the deterioration of the quality of display such as the production of the non-uniformity of display arises. On the other hand, homogenization of the characteristics of TFTs is difficult due to the processes. For this reason, a drive circuit and drive method for compensating for the characteristic dispersion of the drive transistor T1 is desired.

SUMMARY OF THE INVENTION

The present invention advantageously provides a drive circuit of a light emitting device having a drive transistor controlling a drive current to the light emitting device driven by a current includes a gate/source voltage arrangement for applying a voltage between a gate and a source to the drive transistor, the voltage making the drive transistor flow a substantially constant current, and addition circuitry adds a signal voltage to the voltage between the gate and the source of the drive transistor.

Moreover, it may be preferable that the gate/source voltage arrangement includes constant current accepting structure for accepting a constant current from a constant current source provided on an outside, a switch shorting a drain and the gate of the drive transistor, and switching structure for switching a connection between one of the drain and source of the drive transistor and the light emitting device or the constant current source.

Moreover, it may be preferable that both of the switch and the switching structure are thin film transistors.

Moreover, it may be preferable that the switching structure includes a diode and switches the connection by turning on the diode by a forward bias and by turning off the diode by a reverse bias.

Moreover, it may be preferable that all of the switch and components of the switching structure other than the diode are thin film transistors.

Moreover, it may be preferable that the constant current source provided on the outside is an outside driver IC.

Moreover, it may be preferable that the constant current source provided on the outside is composed of a single or a plurality of thin film transistors formed on a substrate.

Moreover, it may be preferable that the light emitting device is an organic EL device.

Moreover, it may be preferable that the addition circuitry changes terminal potential on another side of a capacitor, a terminal on one side of which is connected to the gate of the drive transistor, by a target signal voltage.

Moreover, it may be preferable that a change of a terminal voltage of the capacity changes potential of a signal line connected to the terminal.

Moreover, it may be preferable that change of the terminal voltage of the capacitor be performed by switching a connecting destination of the terminal between the signal line of predetermined potential and a reference potential line.

Moreover, it may be preferable that the time required for applying a voltage corresponding to the constant current between the gate and the source of the drive transistor be equal to a time necessary for applying the signal voltage from the signal line to the capacity.

As described above, according to the present invention, a voltage according to a threshold voltage of a drive transistor is set to the gate of the drive transistor by a constant current from a constant current source. Consequently, it is possible to restrain the dispersion of the characteristics of the drive transistor to obtain a suitable drive voltage by subsequently adding a signal voltage.

Although the present invention may be preferably applied to an organic EL device, the present invention may be applied to any current driven device, especially current drive type light emitting devices.

DETAILED DESCRIPTION OF PREFERRED EMBODIMENT

Hereinafter, a preferred embodiment of the present invention will be described based on the attached drawings. In the present embodiment, after programming a constant current corresponding to a certain gradation current to a drive transistor T, a target gradation as a signal voltage to the gate of the drive transistor T is written by adding a difference between the target gradation and the certain gradation.

Figure 1:
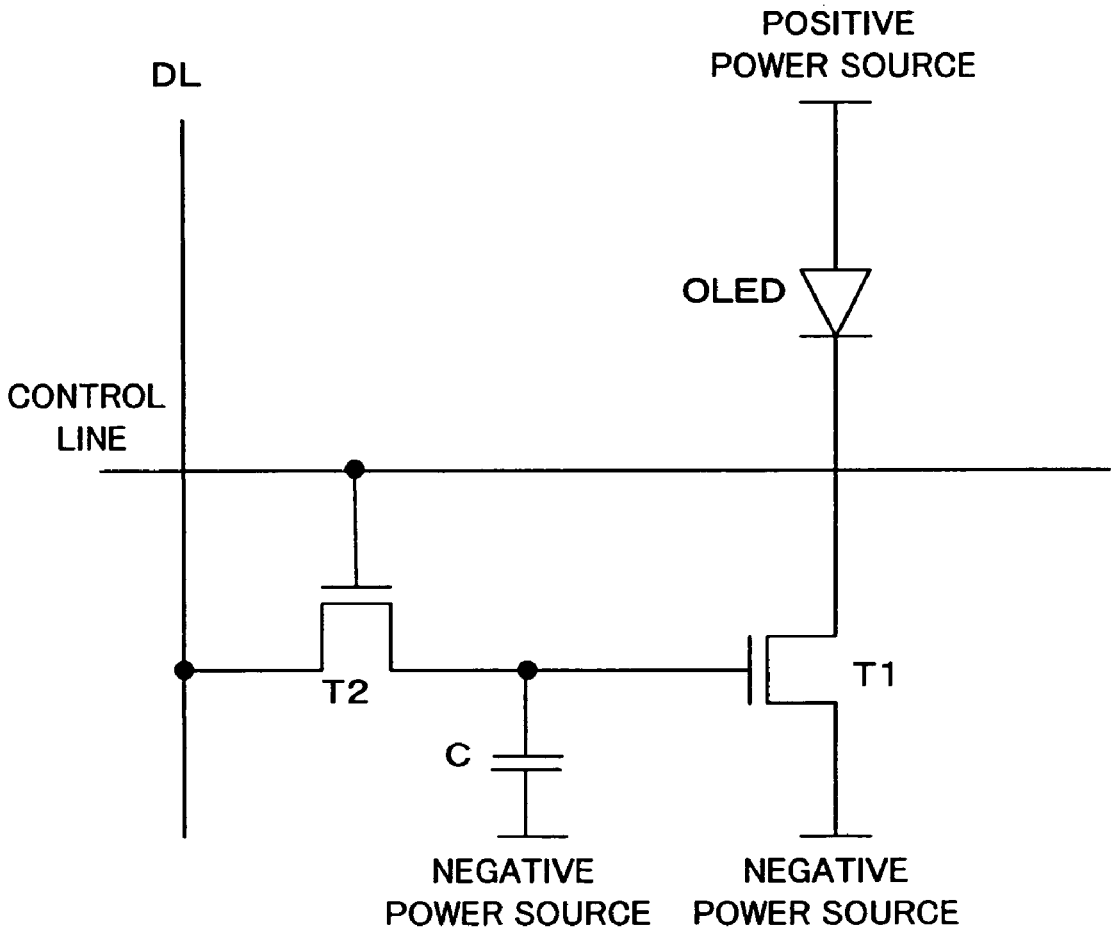
FIG. 1 is a view showing the configuration of a conventional drive circuit.
Figure 2:
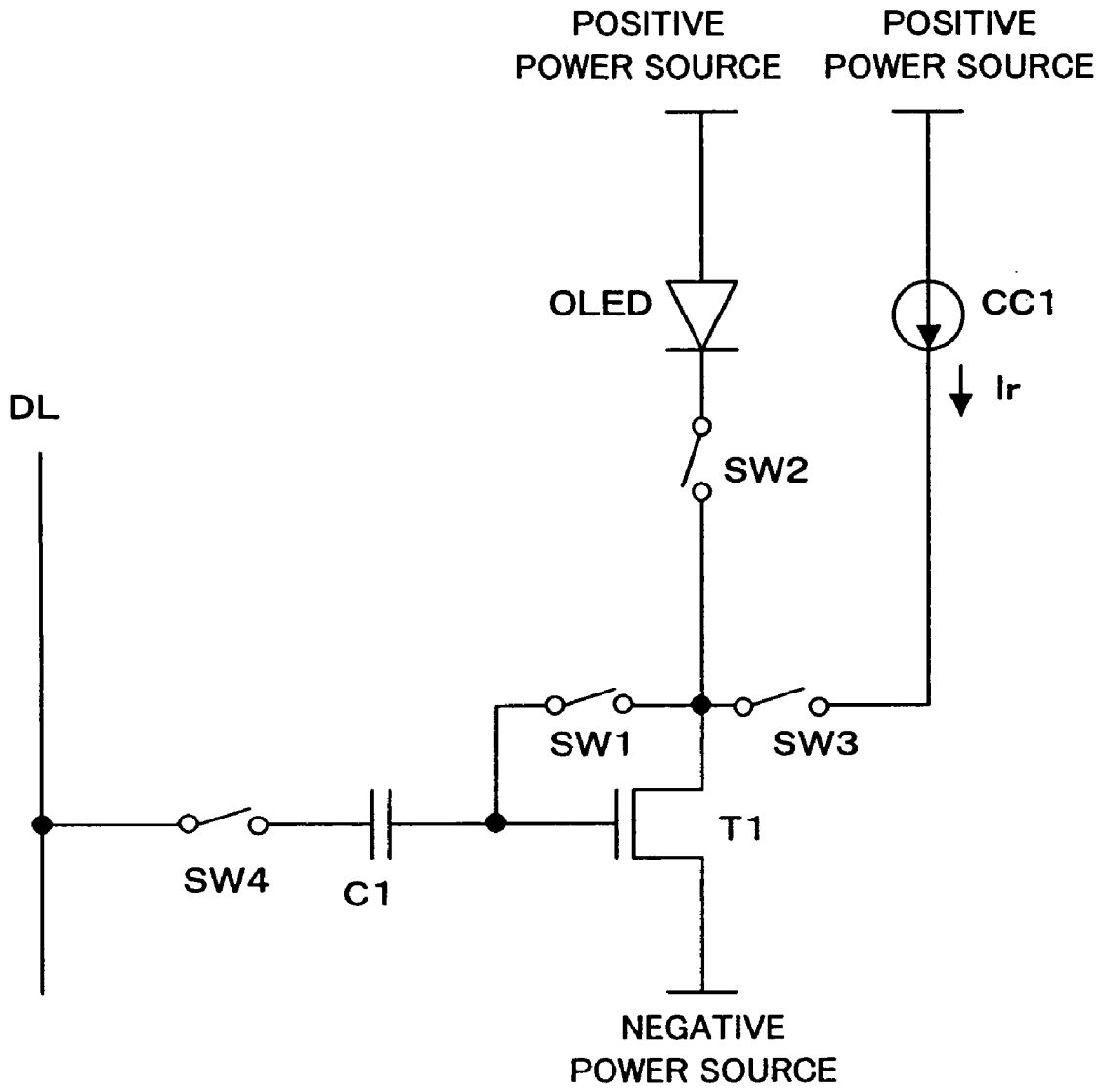
FIG. 2 is a view showing the configuration of a drive circuit according to an embodiment of the present invitation.

As shown in FIG. 2, the pixel circuit of the present embodiment is composed of an organic EL device OLED as the target for driving, a drive transistor T1 supplying a current to the organic EL device OLED, a writing transistor SW4 for charging a signal voltage, a capacitor C1 holding the signal voltage, and switches SW1, SW2 and SW3 for programming a certain constant external reference current Ir to the drive transistor T1.

The gate of the drive transistor T1 is connected to one end of the switch SW4 through the capacitor C1. The other end of the switch SW4 is connected to a signal line DL, through which the signal voltage indicating a display gradation of the pixel is supplied. Consequently, by turning on the switch SW4, the signal voltage is written in the gate of the drive transistor T1. The switch SW1 is provided between the gate and the drain of the writing transistor T1, and the gate and the drain of the writing transistor T1 is shorted by turning on the switch SW1.

The switch SW2 is provided between the drain (or the source) of the drive transistor T1 and the organic EL device OLED, and the drain current of the drive transistor T1 flows through the organic EL device OLED by turning on the switch SW2. The switch SW3 is provided between the drain (or the source) of the drive transistor T1 and a constant current source CC1, and the constant current Ir from the constant current source CC1 is supplied to the drain (or the source) of the transistor T1 by turning on the switch SW3.

In such a circuit, the switches SW1 and SW3 are turned on, and the switch SW2 is turned off. Thereby, the gate and the drain of the drive transistor T1 are shorted, and the constant current Ir is supplied to the drain of the drive transistor T1 in this state. Consequently, the constant current Ir flows towards the negative power source. Then, by shorting the gate and the drain of the drive transistor T1 to make the current Ir flow in such a way, a voltage Vr corresponding to the drain current Ir is stored between the gate and the source of the drive transistor T1. That is, the gate voltage of the drive transistor T1 becomes a voltage which exceeds the voltage of the negative power source by a voltage Vr. Because the voltage Vr differs according to the characteristics of each of the drive transistors T1, the voltage Vr normally shifts from a typical value Vro by a voltage dVr. That is, the voltage Vr becomes Vr=Vro+dVr.

Next, when the switches SW1 and SW3 are turned off and a target voltage corresponding to the target gradation current Is (the current desired to flow through the organic EL device OLED) is denoted by Vs, a suitable difference voltage is given to the terminal of the capacitor C1 on the side of the switch SW4 so that the gate potential of the drive transistor T1 may change by a voltage Vs−Vro. Thereby, the gate/source voltage of the drive transistor T1 becomes a target voltage Vs+dVr, and the voltage obtained by correcting the characteristic dispersion voltage dVr of the drive transistor T1 is applied between the gate and the source.

Finally, the switch SW2 is turned on, and the target current Is is flown through the organic EL device OLED to emit light.

Here, when it is supposed that the relation between the drain current Id and the gate/source voltage Vgs of the drive transistor T1 is $$Id=f(Vgs)=uCW/L*(Vgs-Vth)^2 \quad (1),$$

the relation fi of the Idi−Vgs of a certain drive transistor T1 is $$Idi=fi(Vgs)=ki*fo(Vgs-dVthi) \quad (2),$$

where, u denotes a mobility, C denotes a gate capacity, and W and L denote a channel width and a channel length of the transistor, respectively. Hereupon, fo denotes a typical Id-Vgs function, and fi means the inclusion of a dispersion from a typical function fo. Furthermore, ki denotes a ratio of the mobility of the drive transistor Ti to the typical value, and dVthi denotes a difference of the threshold value of the drive transistor Ti from the typical value.

The I-V relation of the drive transistor Ti at the time of programming the constant current Ir becomes $$Ir=fi(Vri)=ki*fo(Vri-dVthi) \quad (3).$$

where Vri denotes the gate/source voltage when the constant current Ir is flown through the drive transistor Ti.

On the other hand, the function fo has an inverse function. When it is expressed by fo(−1), the formula (3) is expressed as $$Vri-dVthi=fo(-1)(Ir/ki) \quad (4).$$

Similarly, with regard to a typical drive transistor To, the typical reference voltage Vro can be expressed as $$Vro=fo(-1)(Ir) \quad (5).$$

Consequently, when a difference voltage Vs−Vro of the target signal voltage Vs and the typical reference voltage Vro is added to the gate/source voltage Vri, which is stored as described above, through the capacitor C1, a drain current Ii of the drive transistor Ti becomes $$Ii=fi(Vgsi)=fi(Vs-Vro+Vri)=ki*fo(Vs-Vro+Vri-dVthi) \quad (6).$$

Consequently, from the formulae (4) and (5), the drain current Ii becomes $$Ii=ki*fo\{Vs-fo(-1)(Ir)+fo(-1)(Ir/ki)\} \quad (7).$$

When the result is compared with the formula (2) of the conventional two-transistor circuit, the influence of the difference dVthi disappears, and the influence of the dispersion of the ratio ki is also restrained. Consequently, it is found that the dispersion of the current flowing through the drive transistor Ti is restrained as compared with the conventional art.

It should be noted that the signal voltage supplied to the signal line DL is a signal composed of a luminance signal of every color R, G and B. Accordingly, what is necessary is just to convert the luminance signal to a signal voltage Vs−Vro.

EXAMPLES

As for the above-mentioned configuration of FIG. 2, various circuit configurations and drive methods can be considered according to the programming methods of the constant current Ir and the writing methods of the difference voltage Vs−Vro.

Although some examples are cited below, the circuit configurations and the drive methods should not be limited to these examples. Moreover, although n-channel type TFTs are adopted as the drive transistors in the examples, the same effects can be obtained by switching the polarity of currents using p-channel type transistors.

Example 1

Figure 3:
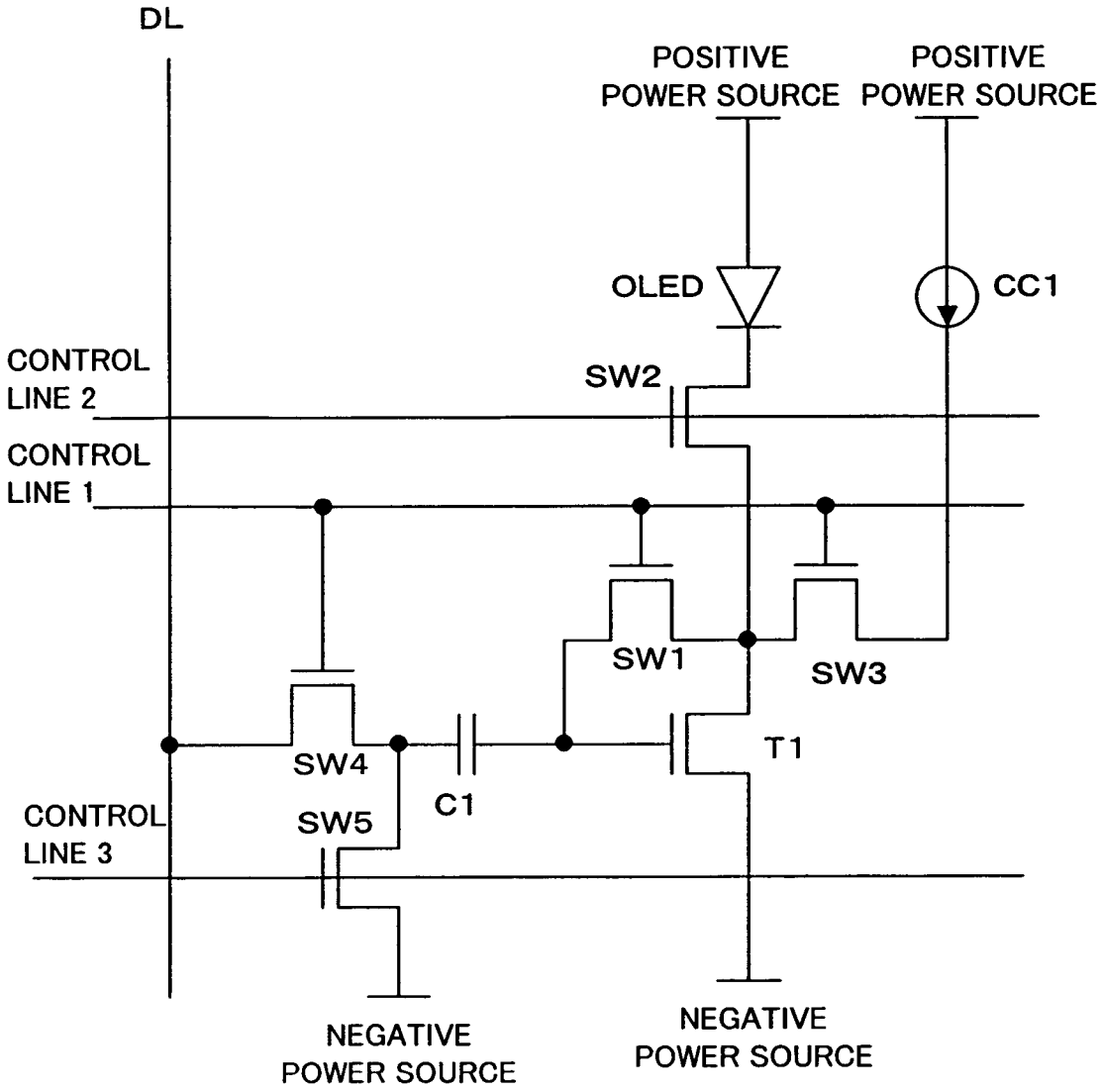
FIG. 3 is a view showing an example circuit according to the present invention.

An example of a circuit realizing the driving of the present invention is shown in FIG. 3. As in the configuration shown in FIG. 2, switches SW1, SW2, and SW3 are arranged between the drain of the drive transistor T1 and the gate thereof; between the drain of the drive transistor T1 and the cathode of the organic EL device OLED; and between the drain of the drive transistor T1 and the constant current source CC1, respectively. Moreover, the switch SW4 is provided between the capacitor C1 and the signal line DL. Furthermore, in the example of FIG. 3, the connecting point of the switch SW4 and the capacitor C1 is connected to the negative power source through a switch SW5.

Moreover, all of the switches SW1-SW5 are composed of n-channel TFTs. The gates of the switches SW1, SW3, and SW4 are connected to a control line 1; the gate of the switch SW2 is connected to a control line 2; and the gate of the switch SW5 is connected to a control line 3.

In this circuit, the control line 1 is raised to the H level to turn on the switches SW1, SW3, and SW4, and the control lines 2 and 3 are placed at the L level to turn off the switches SW2 and SW5. Thereby, a voltage corresponding to the constant current Ir is programmed to the gate of the drive transistor T1 (the corresponding voltage Vr is set). At this time, the switch SW4 is turned on, and a voltage of −(Vs−Vro) has been applied to the switch SW4 side of the capacitor C1 through the signal line DL. Consequently, the voltage of Vr−(Vs−Vro) is charged in the capacitor C1.

Next, the control line 1 is made to be the L level, and the control line 3 is made to be the H level. Because the switches SW1, SW3, and SW4 are turned off and the switch SW5 is turned on as a result, the voltage of the connecting point of the switch SW4 and the capacitor C1 changes from the voltage of −(Vs−Vro) to 0 V (the negative power source voltage is 0 V). Consequently, the voltage of Vs−Vro is added to the drive transistor T1 side terminal (gate) of the capacitor C1. Thereby, the gate of the drive transistor T1 has a voltage of Vs−Vro+Vr. Then, a current according to the gate voltage Vs−Vro+Vr of the drive transistor T1 is supplied to the organic EL device OLED by turning on the switch SW2. It should be noted that the voltage Vr here is the voltage Vr about the drive transistor T1 of one pixel, and is the voltage Vri.

Figure 4:
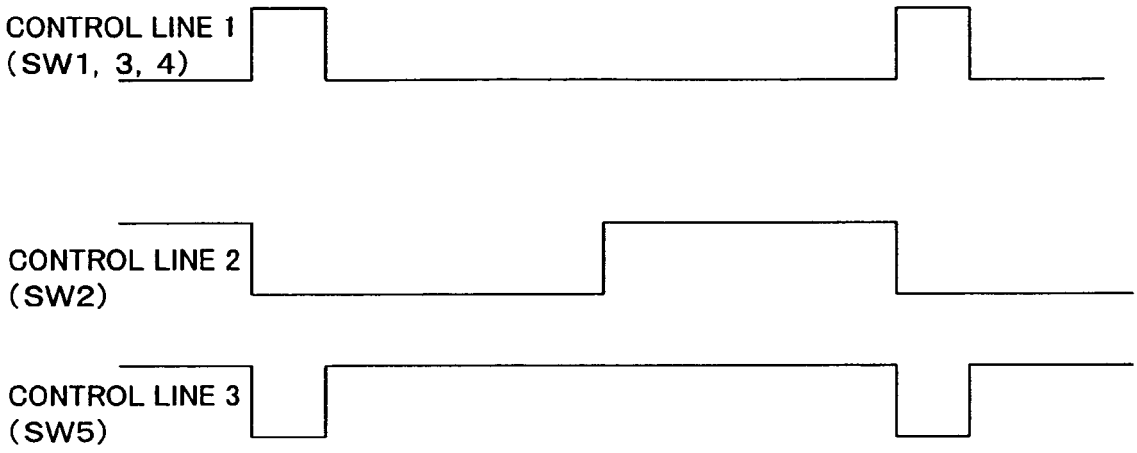
FIG. 4 is a timing chart illustrating the operation of the example circuit shown in FIG. 3.

The timing of turning on and off of each switch is illustrated in FIG. 4. In such a way, when the switches SW1, SW3 and SW4 are turned on, the switches SW2 and SW5 are turned off. Thereby, the programming of setting the gate voltage to Vr is performed, and the amount of the charge of the capacitor C1 is made to be the voltage of Vs−Vro+Vri. Then, the switches SW1, SW3 and SW4 are turned off, and the switch SW5 is turned on. Thereby, the charge voltage of the capacitor C1 is fixed. Then, turning on the switch SW2 will cause the organic EL device OLED to emit light. Changes of the charge voltage of the capacitor C1 can be restrained by delaying the turning on of the switch SW2 to the turning on of the switch SW5.

Figure 5:
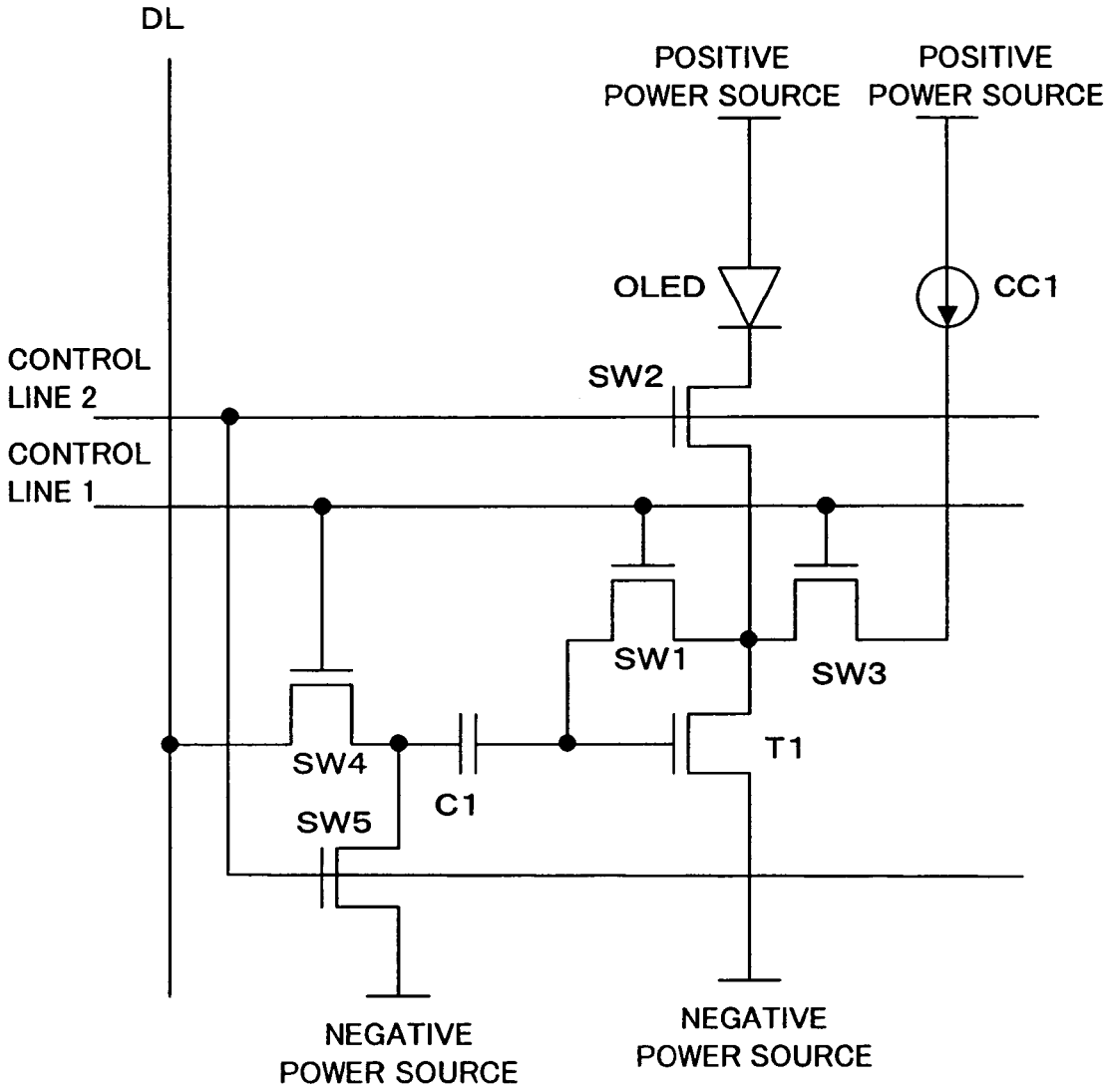
FIG. 5 is a view showing another example circuit according to the present invention.
Figure 6:
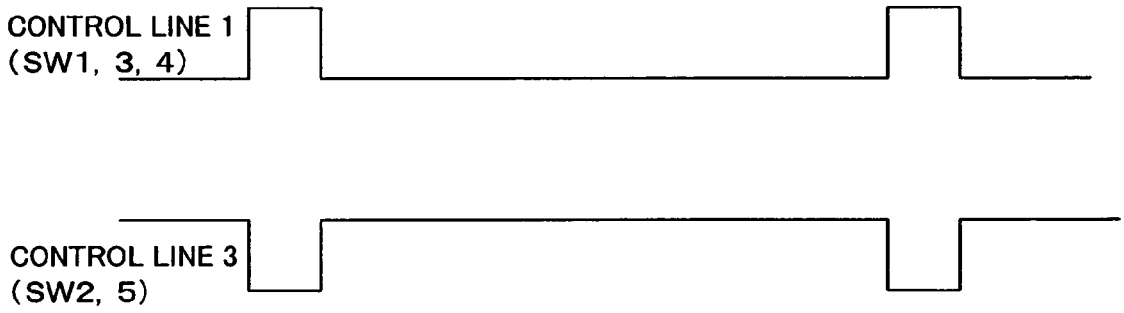
FIG. 6 is a timing chart illustrating the operation of the example circuit shown in FIG. 5.

FIG. 5 shows a circuit in which the switches SW2 and SW5 are connected to the same control line 3. With such a configuration, the same operation as that of FIG. 3, which is described above, is attained by controlling the control lines 1 and 3, as shown in FIG. 6. Although the configuration of FIG. 5 is preferable in view of having fewer control lines, a problem remains in that, when the switch SW2 is turned on before the turning on of the switch SW5, the electric charges charged in the capacitor C1 escape, such that there are greater variations in the gate voltage of the drive transistor T1.

Figure 7:
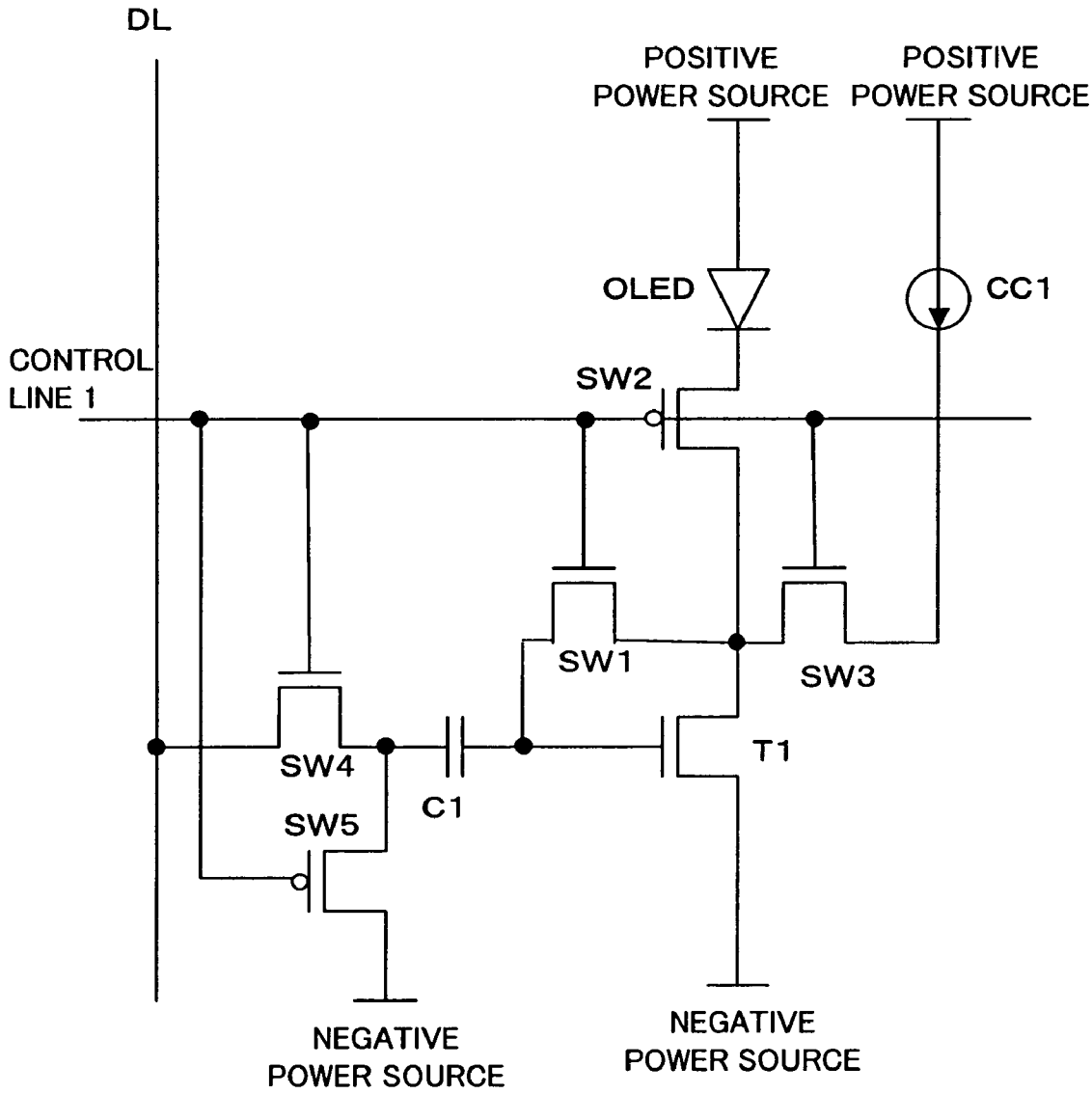
FIG. 7 is a view showing another example circuit according to the present invention.

FIG. 7 shows a circuit in which the switches SW1, SW3 and SW4 are n-channel and the switches SW2 and SW5 are p-channel to perform the switching of all of the switches SW1-SW5 using one control line 1. The operation of the example is the same as that shown in FIG. 5.

Figure 8:
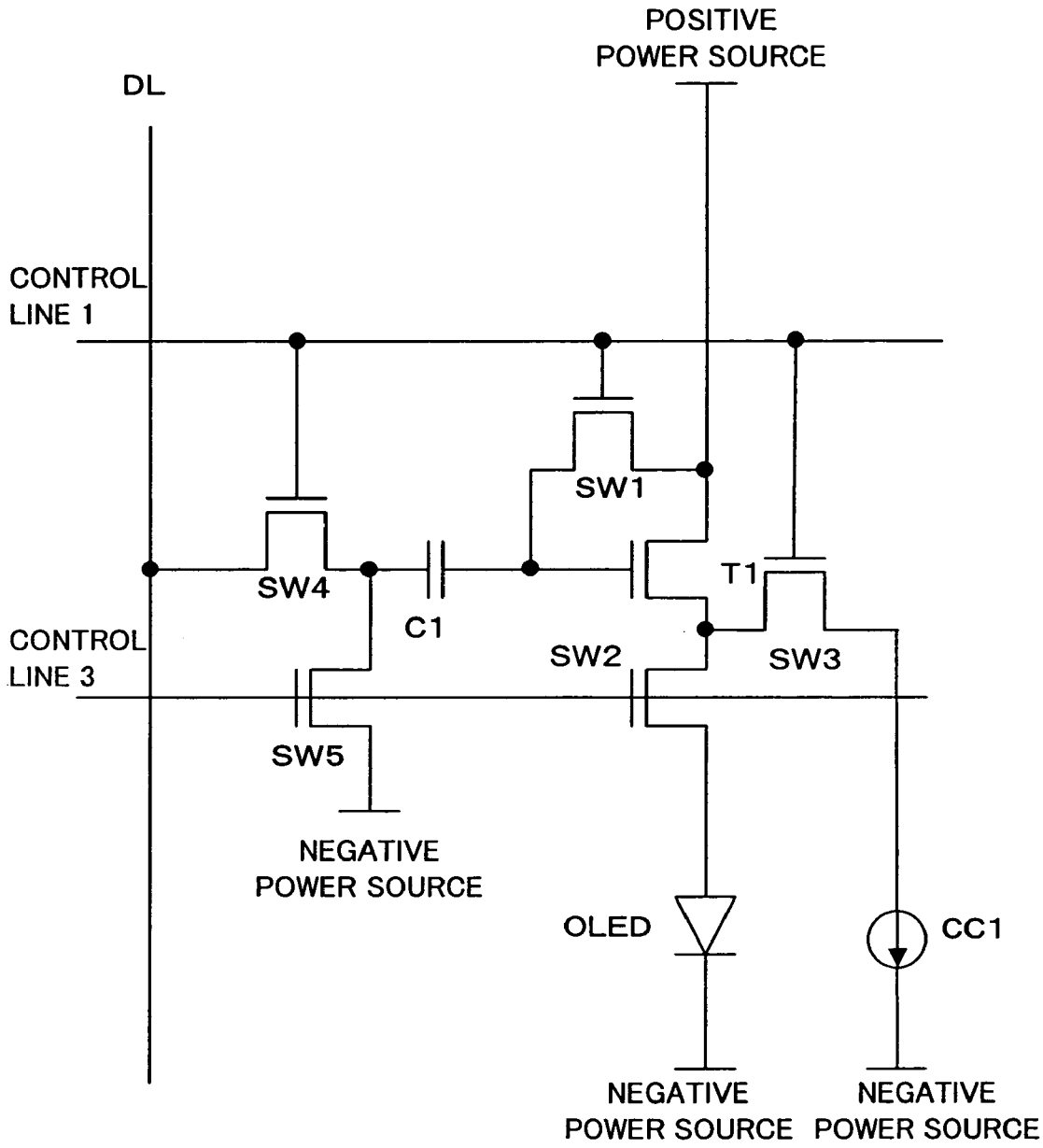
FIG. 8 is a view showing another example circuit according to the present invention.

FIG. 8 shows a circuit in which the constant current source CC1 is connected to the source of the drive transistor T1 through the switch SW3 and the anode of the organic EL device OLED is connected to the source of the drive transistor T1 through the switch SW2. Here, the cathode of the organic EL device OLED is connected to the negative power source.

Such a circuit operates similarly to the circuit shown in FIG. 5. That is, the switches SW1, SW3 and SW4 are turned on and the switches SW2 and SW5 are turned off. Then, the voltage corresponding to the constant current is set to the gate of the drive transistor T1; the switches SW1, SW3, and SW4 are turned off; and the switch SW5 is turned on. Thereby, the gate voltage of the drive transistor T1 is fixed. Then, the switch SW2 is turned on, and the organic EL device OLED emits light.

Figure 9:
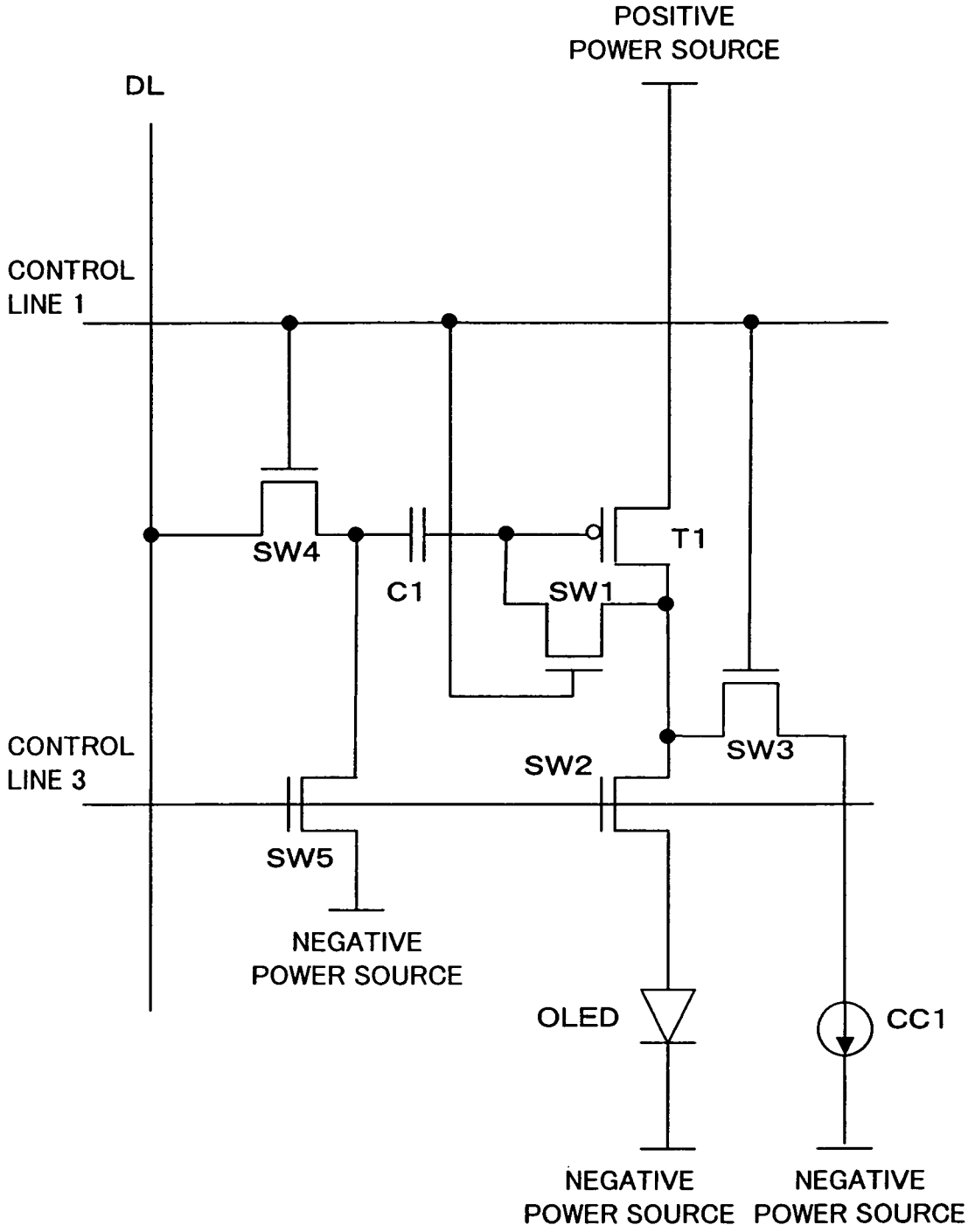
FIG. 9 is a view showing another example circuit according to the present invention.

FIG. 9 shows an example in which a p-channel TFT is used as the drive transistor T1. In this example, a voltage of a positive power source voltage VDD−Vr is stored in the gate of the drive transistor T1 in a programming period, and a difference voltage of (Vs−Vro) is subtracted from the voltage VDD−Vr. Then, the same operation can be obtained by setting the target voltage to be a signal having an opposite polarity (the luminance is higher as the voltage is lower) performing the subtraction from the power source voltage.

Although to simplify understanding only one pixel circuit is shown in the embodiment described above, in a normal display apparatus pixels are arranged in a matrix and the display of each pixel is controlled to create the image produced on the display. Therefore, under normal conditions, the operation described above is simultaneously performed for all pixels in one horizontal line. Then, the control described above can be performed by providing one or two horizontal control lines. On the other hand, it is normal that the luminance signal (video signal) for the display of each pixel is supplied in a dot sequential order, and a signal voltage corresponding to the vide signal may be sequentially set on each signal line, and the signal voltages may be supplied to all of the signal lines at the same time after setting the signal voltages for one line.

PARTS LIST

1 control line
2 control line
3 control line
C capacitor
CC1 current source
C1 capacitor
D1 signal line
dVr voltage
H level
IC outside driver
Ir constant current
Is current
ki ratio
L level
SW1 switch SW2 switch
SW3 switch
SW4 switch
SW5 switch
T drive transistor
T1 n-channel drive transistor
T2 n-channel writing transistor
Vr voltage
Vro value
Vs current

The invention claimed is:

1. A drive circuit of an organic electroluminescent (EL) device, comprising:

a) a drive transistor for controlling a drive current to the EL device and having a gate, a drain and a source;

b) a first switch between the gate and drain of the drive transistor and a second switch between the EL device and the drain or source of the drive transistor;

c) a constant current source for supplying a reference current to the drive transistor and a third switch between the constant current source and the source or drain of the drive transistor, wherein the constant current source and the EL device are not simultaneously connected to the source or drain of the drive transistor, so that when the third switch is turned on the gate and drain of the drive transistor are shorted, the reference current flows in the drive transistor, and a characteristic voltage corresponding to the reference current and to the characteristics of the drive transistor is stored between the gate and source of the drive transistor; and d) a capacitor for holding a charged voltage, a signal line for supplying a signal voltage indicating a display gradation of the pixel, and a fourth switch between the signal line and the capacitor; and e) means for turning on the first, third and fourth switches, the turning off the second switch, and providing a signal voltage, so that a voltage corresponding to the signal voltage and the characteristic voltage of the drive transistor is charged in the capacitor as the charged voltage; and for next turning off the first, third and fourth switches and turning on the second switch to cause a drain current related to the charged voltage to flow through the EL device, whereby the EL device emits light related to the charged voltage.

2. The drive circuit of claim 1, wherein each switch is an n-channel thin film transistor, and wherein the second switch is disposed between the EL device and the drain of the drive transistor.

* * * * *